US008801469B2

(12) United States Patent
Wu et al.

(10) Patent No.: US 8,801,469 B2
(45) Date of Patent: Aug. 12, 2014

(54) ELECTRICAL CONNECTOR HAVING A HOUSING WITH DIFFERENT DIELECTRIC CONSTANT

(75) Inventors: Jerry Wu, Irvine, CA (US); Jun Chen, Kunshan (CN); Hong-Lei Fan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 12 days.

(21) Appl. No.: 13/564,725

(22) Filed: Aug. 2, 2012

(65) Prior Publication Data

US 2013/0034995 A1 Feb. 7, 2013

(51) Int. Cl.

| | |
|---|---|
| ***H01R 24/00*** | (2011.01) |
| ***H01R 13/6477*** | (2011.01) |
| *H01R 24/62* | (2011.01) |

(52) U.S. Cl.

CPC ..... *H01R 13/6477* (2013.01); *H01R 24/62* (2013.01)

USPC ..... 439/660; 439/607.01

(58) Field of Classification Search

USPC ..... 439/607.01, 607.45, 607.5, 660

See application file for complete search history.

(56) References Cited

U.S. PATENT DOCUMENTS

| | | | | |
|---|---|---|---|---|
| 7,371,118 | B2 * | 5/2008 | Wu | 439/607.45 |
| 7,410,366 | B2 * | 8/2008 | Wu | 439/76.1 |
| 7,534,141 | B1 * | 5/2009 | Wu | 439/607.01 |
| 7,618,293 | B2 * | 11/2009 | Wu | 439/660 |
| 7,632,155 | B1 * | 12/2009 | Wu | 439/660 |
| 7,651,379 | B1 * | 1/2010 | Wu | 439/660 |
| 7,909,632 | B2 * | 3/2011 | Wu | 439/353 |
| 7,955,137 | B2 | 6/2011 | Ko et al. | |

FOREIGN PATENT DOCUMENTS

| | | |
|---|---|---|
| CN | 101345373 A | 1/2009 |
| CN | 201576802 U | 9/2010 |

* cited by examiner

*Primary Examiner* — Thanh Tam Le

(74) *Attorney, Agent, or Firm* — Wei Te Chung; Ming Chieh Chang

(57) ABSTRACT

An electrical connector for mounting to a print circuit board includes an insulative housing, a metal shell shielding around the housing and a plurality of terminals received in the housing. Each terminal having a body section and a contact section extending from the body section, the housing includes a first housing and a second housing, the body section being received in the second housing and the contact section extending from the second housing to the first housing. The first housing has a first dielectric constant and the second housing has a second dielectric constant higher than the first dielectric constant so as to prevent the characteristic impedance change.

17 Claims, 6 Drawing Sheets

ELECTRICAL CONNECTOR HAVING A HOUSING WITH DIFFERENT DIELECTRIC CONSTANT

FIELD OF THE INVENTION

The present invention relates to an electrical connector, and more particularly to an electrical connector having a housing with different dielectric constant to prevent characteristic impedance change.

DESCRIPTION OF THE RELATED ART

An electrical connector is disclosed in U.S. Pat. No. 7,955,137 issued to Ko et al. on Jun. 7, 2011. Said connector includes an insulative housing and a number of terminals received in the housing. The terminal includes a body section, a contact section and a soldering section extending from opposite side of the body section, all sections of the terminal have a same thickness.

However, the contact section should contact with another connector and the soldering section solder with a cable, respectively, then the thickness of the contact section and soldering section will increase to change the characteristic impedance of the terminal.

In view of the above, a new electrical connector that overcomes the above-mentioned disadvantages is desired.

SUMMARY OF THE INVENTION

An object of the present invention is to provide an electrical connector with the same characteristic impedance.

In order to achieve the above-mentioned object, an electrical connector includes an insulative housing having a first housing and a second housing received in the first housing; a metal shell shielding the insulative housing; a plurality of terminals received in the insulative housing and each having a body section and a contact section extending from the body section, the body section being received in the second housing and the contact section extending from the second housing to the first housing; said first housing has a first dielectric constant and the second housing has a second dielectric higher than the first dielectric constant.

Other objects, advantages and novel features of the invention will become more apparent from the following detailed description of the present embodiment when taken in conjunction with the accompanying drawings.

DETAILED DESCRIPTION OF THE INVENTION

Figure 1:
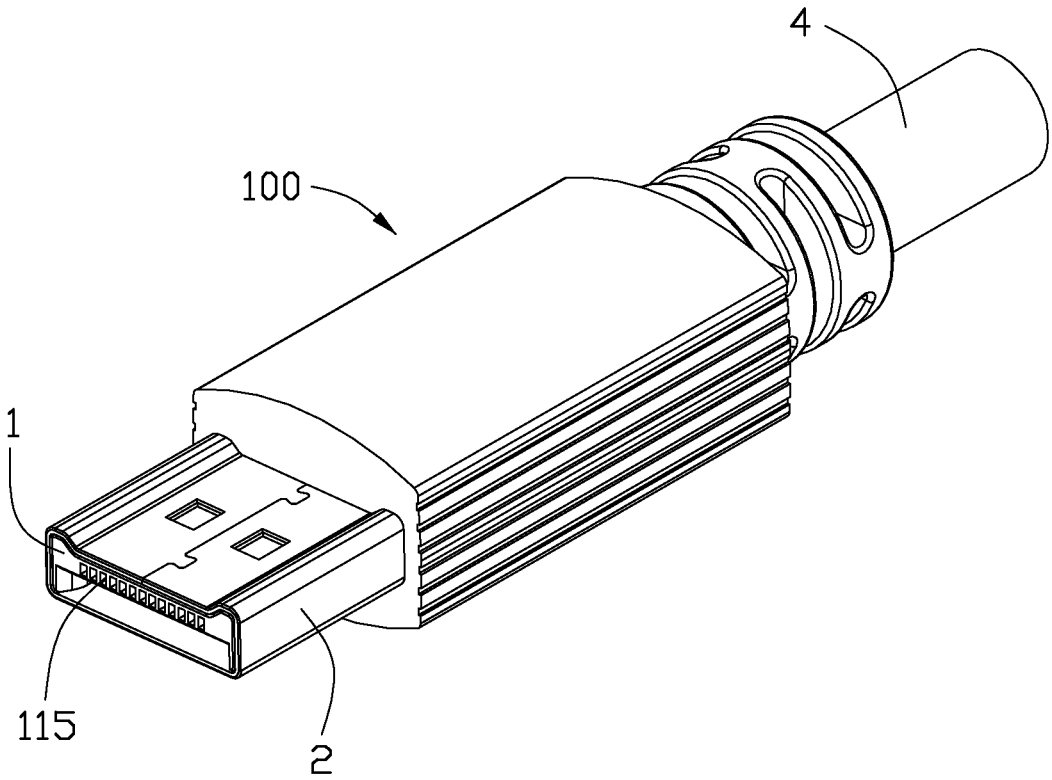
FIG. 1 is a perspective view of an electrical connector of the present invention.

Reference will now be made to the drawing figures to describe the preferred embodiments of the present invention in detail.

Figure 2:
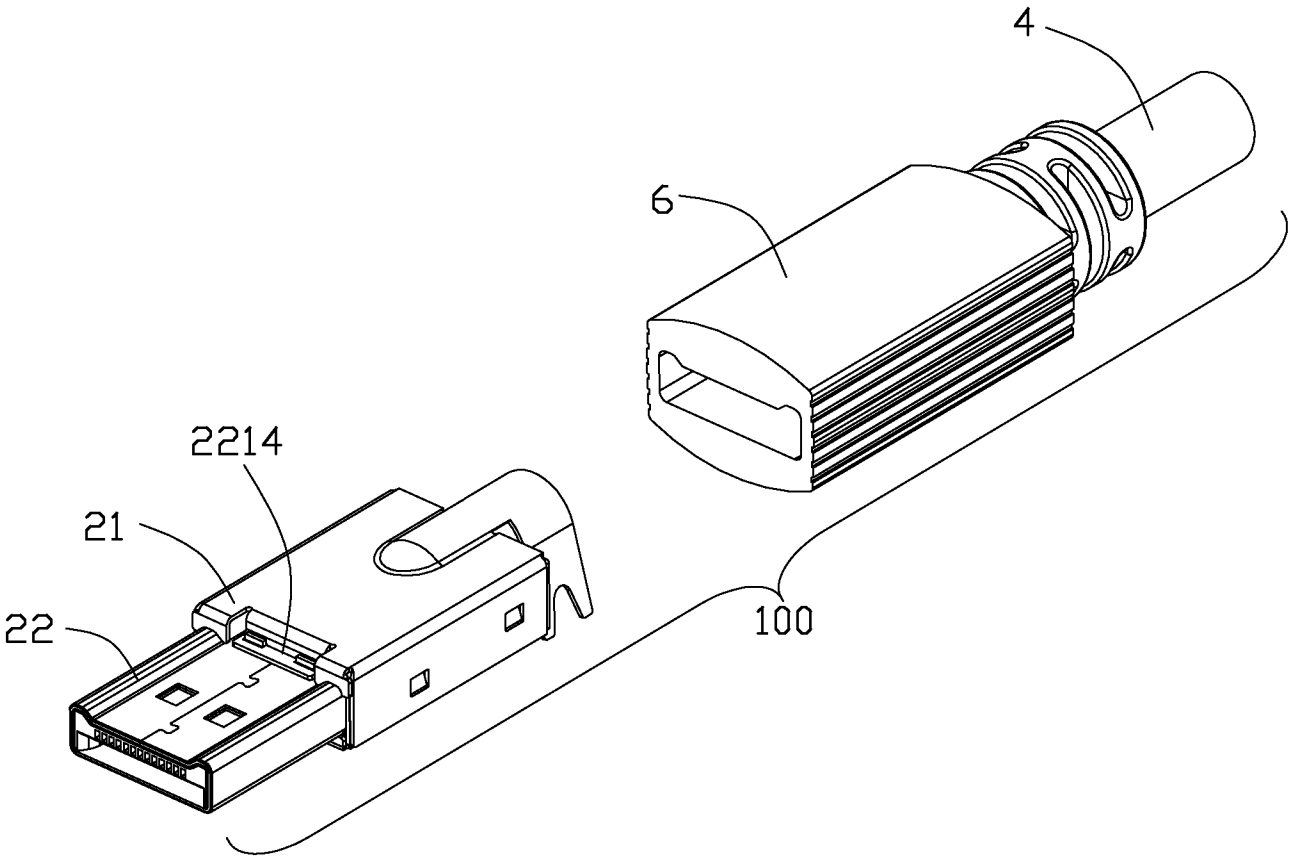
FIG. 2 is a partly exploded view of the electrical connector.
Figure 3:
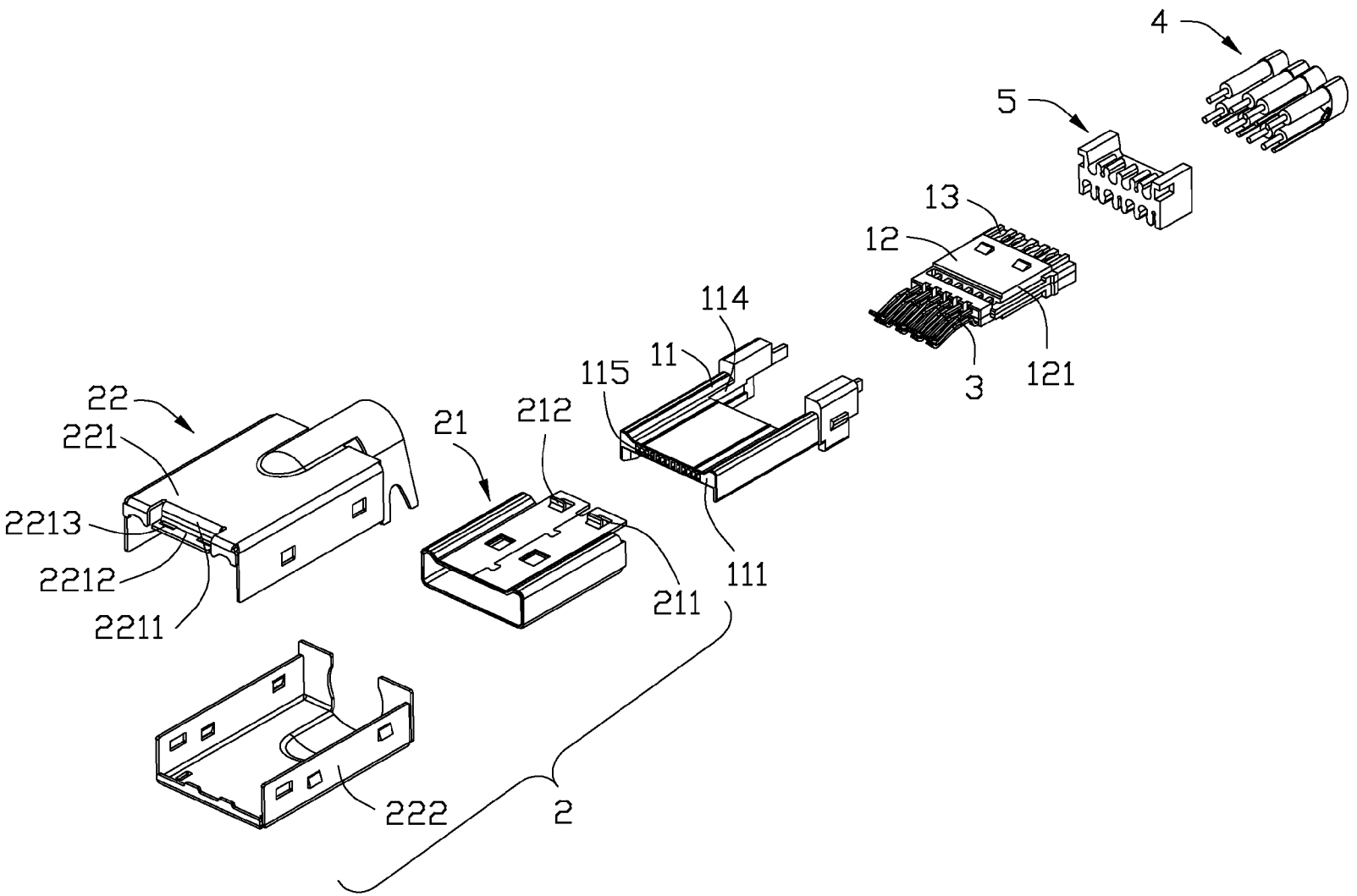
FIG. 3 is an exploded view of the electrical connector except a shell.

Referring to FIG. 1 to FIG. 3, disclosed here is an electrical connector 100 made in accordance with the present invention. The electrical connector 100 is a Diiva cable connector and used for mating a receptacle connector (not shown), said connector 100 includes an insulative housing 1, a metal shell 2 shielding around the insulative housing and a plurality of terminals 3 received in the insulative housing 1, the electrical connector also has a cable 4 which connects with the terminal 3 and a supporting block 5 used for setting and separating the cable 4.

Figure 6:
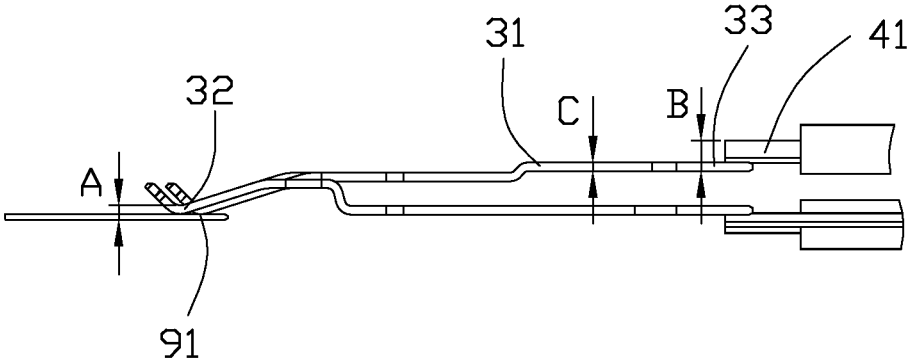
FIG. 6 is a perspective view showing terminals connecting with a mating terminal and cable.

Referring to FIG. 6, each terminal 3 has an average thickness C, the terminal 3 includes a body section 31 and a contact section 32 extending from the body section 31, the terminal 3 also includes a soldering section 33 extending from the body section 31. The soldering section 33 and the contact section 32 are formed on opposite ends of the body section 31. Said contact section 32 mates with a contact portion 91 of the receptacle connector (not shown) and the soldering section 33 is soldered to the soldering portion 41 of the cable 4. A thickness A of the contact position is the thickness of the contact portion 91 plus the thickness of the contact section 32 and a thickness B of the soldering position is the thickness of the soldering section 33 plus the thickness of the soldering portion 41 of the cable 4. Said thickness A of the contact position and the thickness B of the soldering position are thicker than the thickness C of the body section 31, therefore, the contact position and the soldering section has a low impedance and the body section 31 has a high impedance, so the impedance of terminal 3 changes obviously. Said soldering portion 41 is thicker than the contact portion 91 in present invention, in other words, said thickness B of the soldering position is thicker than the thickness A of the contact position, therefore, the soldering position defines lower characteristic impedance than the contact position.

Figure 4:
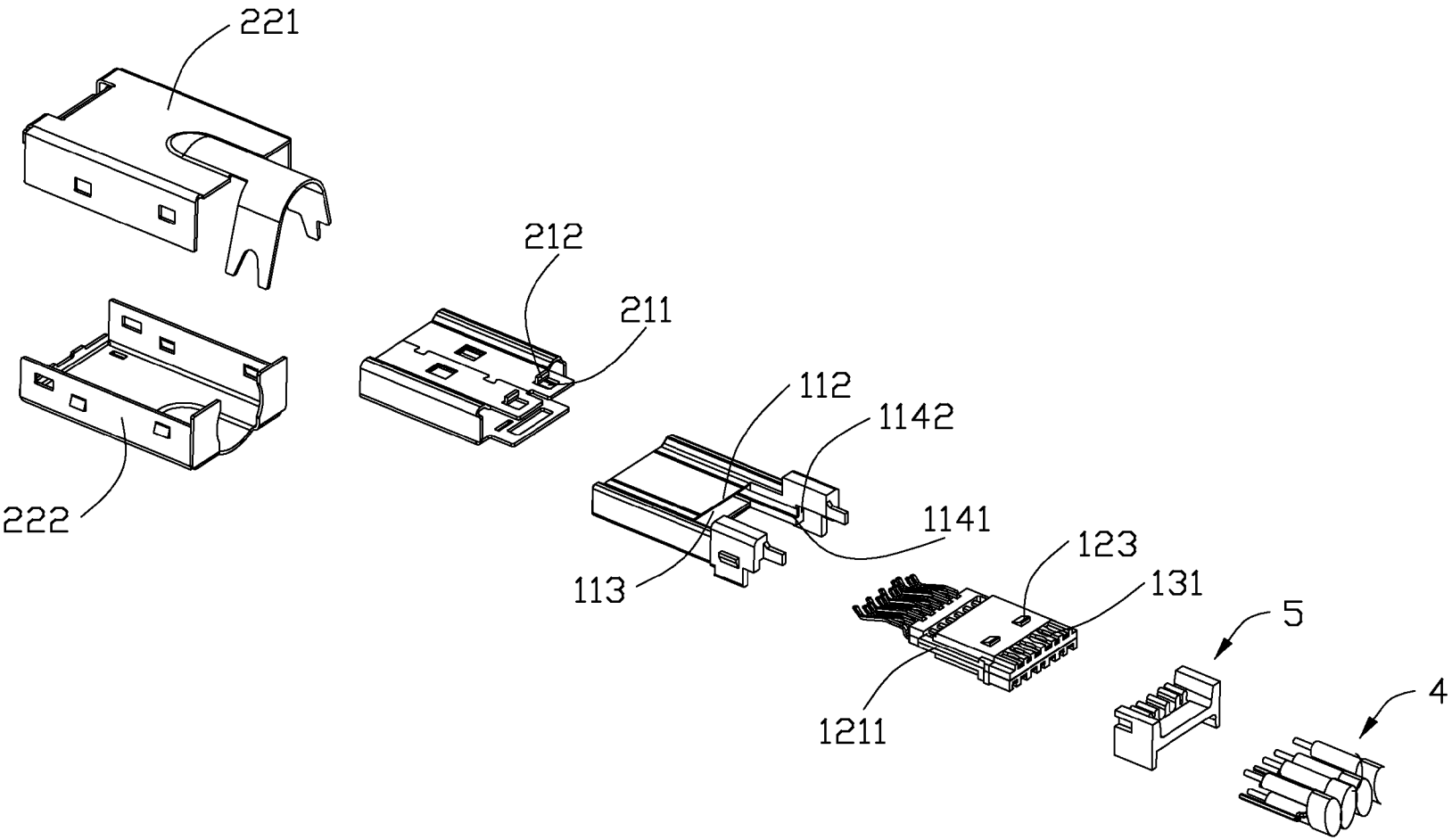
FIG. 4 is another exploded perspective view of the electrical connector shown in FIG. 3.

Referring to FIG. 3 and FIG. 4, said terminals 3 are retained in the insulative housing 1, the insulative housing 1 defining a first housing 11, a second housing 12 received in the first housing 11 and a third housing 13 adjacent to the second housing 12. Said first housing 11 defines a mating face 111 and a rear face 112 opposite to the mating face 111, the first housing 11 runs through the mating face 111 and the rear face 112, and formed a cavity 113. Said cavity 113 defines a pair of guide slots 1141 formed on opposite sidewalls 114 thereof and the guide slots 1141 define a pair of stopping portion 1142 adjacent to the rear face 112, said second housing 12 defines a pair of guide ribs 1211 on opposite sidewalls 121 to be retained in the guide slot 1141. Each guide rib 1211 defines a protrusion portion adjacent to a rear face of the second housing 12 to match with the stopping portion 1142. Said guide slots 1141 are used for the guide rib 1211 slipping therein and said protrusion portions are used for the first housing 11 retaining behind the second housing 12.

Figure 5:
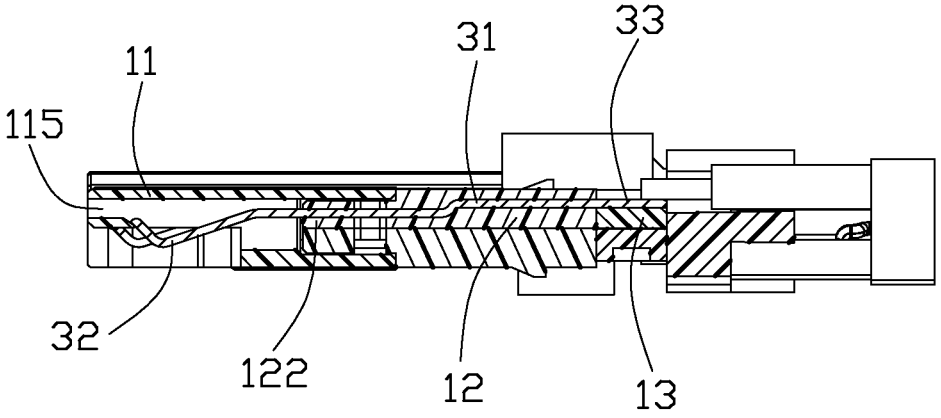
FIG. 5 is an enlarged cross sectional view of the electrical connector.

Combining with FIG. 5, said second housing 12 defines a plurality of second passageways 122 and the body section 31 of terminals 3 are received in the second passageways 122. The contact sections 32 extend to the first housing 11 from the body sections 31, said first housing 11 defines first passageways 115 which communicate with the second passageways 122 for receiving the contact sections 32. The soldering sections 33 extend to the third housing 13 from the body sections 31, said third housing defines a plurality of receiving slots 131 for receiving the soldering sections 33. The first housing 11, second housing 12 and third housing 13 are made of different materials, said first housing 11 has a first dielectric constant and the third housing 13 has a third dielectric constant, said second housing 12 has a second dielectric constant higher than both the first dielectric constant and the third dielectric constant. Understandably, the low dielectric constant of a housing can result in high characteristic impedance of a terminal and the high dielectric constant of a housing can result in low characteristic impedance of a terminal. The contact sections 32 are arranged in the first housing 11 in order to pull high characteristic impedance and the soldering sections 33 are arranged in the third housing 13 for obtaining high characteristic impedance, while the body sections 31 are arranged in the second housing 12 in order to obtain low characteristic impedance. Therefore, the characteristic impedance of everywhere of the terminal 3 could get balance.

Referring to FIG. 3 and FIG. 4, said metal shell 2 includes a mating shell 21 which mates with the receptacle connector and a base shell 22 which is mounted on a rear end of the mating shell 21. The mating shell 21 defines two surfaces opposite to each other, one of the surface outwardly tears out of a pair of openings 211 and formed a pair of tabs 212 which are perpendicular to the openings 211. The base shell 22 comprises a first shell 221 and a second shell 222 assembled to the first shell 221. The first shell 21 has a vertical portion 2211 bending downwardly from an upper face thereof and a horizontal portion 2212 extending horizontally from the vertical portion 2211. Said horizontal portion 2212 defines a pair of grooves 2213 matching with the tab 212. Following the presentation of the insulative housing 1 and the metal shell 2 assembly, said first shell 221 and the second shell 222 form the base shell 22, the mating shell 21 and the base shell 22 are assembled together via the cooperation of through the tabs 212 of the mating shell 21 and the grooves 2213 of the base shell 22. Said mating shell 21 is located at the front end of the base shell 22, the front end of the first housing 11 is received in the mating shell 21, and the rear end of the first housing 11 is supported at the mating shell 21 and received in the base shell 22. The second housing 12 is retained behind the first housing 11 through the guide slot 1141, and the second housing 12 includes a pair of flanges 123 for matching with the openings 211, said first housing 11 and the second housing 12 are stably retained in the mating shell 21. Said third housing 13 which is retained behind the second housing 11 and the supporting block 5 which is retained behind the third housing are received in the base shell 22. The cable 4 is arranged on the supporting block 5 so that the soldering portion 41 can be stably welded with the soldering section 33.

Referring to FIG. 2, said vertical portion 2211 and the horizontal portion 2212 of the base shell 22 form a hollow portion 2214. The outwall of the metal shell 2 is overmolded with a insulative shell 6 and plastic of the insulative shell 6 enters the hollow portion 2214 so as to facilitate stable combination of the metal shell 2 and the insulative shell 6.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector for mating with a receptacle connector, comprising:

an insulative housing having a first housing and a second housing received in the first housing;

a metal shell shielding the insulative housing;

a plurality of terminals received in the insulative housing and each having a body section and a contact section extending from the body section, each part of the terminal have essentially a same thickness, the contact section adapted to connect with other contacting portions of the receptacle connector so as to result in thereabouts a lower impedance compared with the body section, the body section being received in the second housing and the contact section extending from the second housing to the first housing;

wherein the first housing has a first dielectric constant and the second housing has a second dielectric constant higher than the first dielectric constant so as to have an impedance of the whole terminal could get balanced when the electrical connector is mating with the receptacle connector.

2. The electrical connector as described in claim 1, wherein the second housing defines a plurality of second passageways to receive the body sections and the first housing defining a plurality of first passageways communicating with the second passageways to receive the contact sections.

3. The electrical connector as described in claim 2, wherein a soldering section extends from the body section, the soldering section and the contact section are formed on opposite ends of the body section, the insulative housing further comprises a third housing and the soldering section is received in the third housing, the third housing has a third dielectric constant lower than the second dielectric constant.

4. The electrical connector as described in claim 3, wherein said first housing defines a mating face and a rear face opposite to the mating face, the first housing runs through the mating face and the rear face and forms a cavity defining a pair of guide slots formed on opposite sidewalls of the cavity, each guide slot defines a stopping portion adjacent to the rear face, said second housing defines a pair of guide ribs on opposite sidewalls for matching with the guide slots and each guide rib defines a protrusion portion adjacent to a rear face of the second housing for matching with the stopping portion.

5. The electrical connector as described in claim 4, wherein said third housing defines a plurality of receiving slots, the soldering section are arranged on the receiving slots.

6. The electrical connector as described in claim 5, wherein said metal shell has a mating shell and a base shell mounted on a rear end of the mating shell, a front end of the first housing is received in the mating shell, a rear end of the first housing is supported at the mating shell and received in the base shell.

7. The electrical connector as described in claim 6, wherein said mating shell defines two surfaces opposite to each other, one of the surface outwardly torn out of an opening and forms a tab which is perpendicular to the opening, said second housing defines a flange for matching with the opening.

8. The electrical connector as described in claim 7, wherein said base shell comprises a first shell and a second shell assembled with the first shell, the first shell has a vertical portion bending downwardly from an upper face thereof and a horizontal portion extending horizontally from the vertical portion, the horizontal portion defines a groove matching with the tab.

9. The electrical connector as described in claim 8, wherein said third dielectric constant is lower than the first dielectric constant.

10. An electrical connector comprising:

an insulative housing assembly including a first housing and a second housing discrete from each other;

a plurality of conductive contacts associated with the housing assembly, each of said contacts including a front mating section, a rear soldering section and a body section therebetween, the mating section and the soldering section adapted to be connected with other external conductive parts so as to result in thereabouts a lower impedance compared with the body section;

the body section being closer to the second housing than to the first housing, thereby being electrically affected by the second housing more than by the first housing, wherein a dielectric constant of said second housing is larger than that of the first housing to compensate impedance difference between the body section and at least one of the mating section and the soldering section; and each of the plurality of conductive contacts has essentially a same cross-sectional dimension therealong.

11. The electrical connector as claimed in claim 10, wherein the mating section is closer to the first housing than to the second housing and thus electrically affected by the first housing more than by the second housing.

12. The electrical connector as claimed in claim 10, wherein the body section is insert molded within the second housing.

13. The electrical connector as claimed in claim 10, wherein the first housing defines a mating port in which the mating sections are located.

14. The electrical connector as claimed in claim 10, wherein the housing assembly further includes a third housing, under condition that the mating section is closer to the first housing than to the second housing or the third housing, the body section is closer to the second housing than to the first housing or the third housing, and the soldering section is closer to the third housing than to the first housing or the second housing, wherein the electric constant of the third housing is larger than that of the second housing.

15. The electrical connector as claimed in claim 10, wherein said second housing is enclosed in the first housing.

16. The electrical connector as claimed in claim 10, wherein the first housing and the second housing are assembled to each other.

17. An electrical connector comprising:

an insulative housing assembly including a first housing and a second housing discrete from each other;

a plurality of contacts disposed in the housing assembly, each of said contacts defining a front mating section, a rear soldering section and a body section therebetween, the front mating section and the rear soldering section being adapted to be joined with other external conductive parts to form a combo cross-section thereby lowering an impedance thereof while the body section not, under condition that the body section is fully intimately surrounded by the second housing while both the front mating section and the rear soldering section are not fully intimately surround by the first housing but in an exposed manner; wherein an dielectric constant of the second housing is larger than that of the first housing for compensation of dielectric constant difference between the body section and at least one of the front mating section and the rear soldering section; and each of the plurality of contacts has essentially a same cross-sectional dimension therealong.

* * * * *